United States Patent [19]

Dahlitz

[11] 4,417,521

[45] Nov. 29, 1983

[54] BULLET FOR MUZZLE LOADING GUNS

[75] Inventor: Ronald R. Dahlitz, Whittier, Calif.

[73] Assignee: Buffalo Bullet Company, Whittier, Calif.

[21] Appl. No.: 315,060

[22] Filed: Oct. 26, 1981

[51] Int. Cl.[3] ..... F42B 11/20

[52] U.S. Cl. ..... 102/511

[58] Field of Search ..... 86/19; 42/90; 102/501, 102/511, 507–510, 366

[56] References Cited

U.S. PATENT DOCUMENTS 634,383 10/1899 Webley ..... 102/509

1,895,207 1/1933 Rinkel ..... 102/511

3,356,029 12/1967 Seidel ..... 102/511

OTHER PUBLICATIONS

*The Winchester Shotgun Slug* by Karl Foster American Rifleman, Oct. 1936.

*Primary Examiner*—Harold J. Tudor

*Attorney, Agent, or Firm*—Edgar W. Averill, Jr.

[57] ABSTRACT

A bullet for muzzle loading guns and other firearms. The bullet has a pair of gas seals, a pair of knurled portions and at least one grease groove. A solid lubricant is positioned in the depressions of the knurled portions and also in the grease groove or grooves.

7 Claims, 4 Drawing Figures

BULLET FOR MUZZLE LOADING GUNS

BACKGROUND OF THE DISCLOSURE

The field of the invention is ammunition for firearms, and the invention relates more specifically to bullets for muzzle loading rifles. Muzzle loading firearms have been used for about 300 years and practical rifled muzzle loaders were developed around 1830 and perfected during the Civil War. Muzzle loading rifles are now used by hobbiests and can achieve a surprising degree of accuracy utilizing the proper bullets.

The typical bullet used for muzzle loading firearms contains two gas seal rings which are smooth cylindrical rings. A solid lubricant such as beeswax is often placed adjacent one or both of the gas seal rings. Accuracy with such bullets is marginal, however, and a more accurate bullet for muzzle loading firearms which still has good lubricating qualities is needed.

SUMMARY OF THE INVENTION

The present invention is for a bullet for muzzle loading firearms. The bullet has a generally cylindrical-shaped body terminating at its upper end with a generally hemi-spherical nose having a truncated upper end. A first gas seal comprising a cylindrical portion is located adjacent the nose and extends to the outer surface of the cylindrical body. A first knurled portion is positioned below the first gas seal. The knurled portion has a plurality of depressions having walls which extend to about the surface of the cylindrical body. A second gas seal also comprising a cylindrical portion extending to the outer surface of the body is positioned below the first knurled portion. The second gas seal has at least one grease groove adjacent thereto. The grease groove is an annular groove extending below the surface of the body. A second knurled portion is positioned below the second gas seal and has a plurality of depressions having walls which extend to about the surface of the cylindrical body. A solid lubricant is located in the grease grooves and in the depressions of the knurled portions. In a preferred embodiment, the knurled portions have diamond-shaped depressions, and there are two grease grooves surrounding the second gas seal.

DESCRIPTION OF THE PREFERRED EMBODIMENTS

Figure 1:
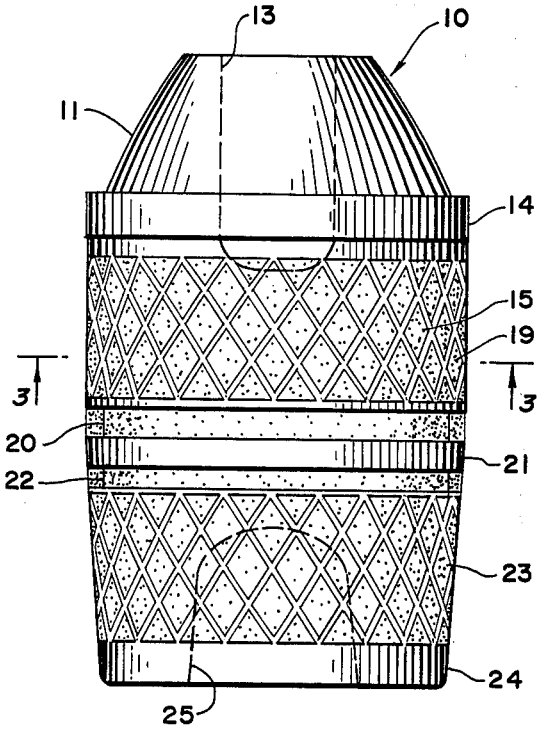
FIG. 1 is a side view of the bullet of the present invention.

A bullet 10 is shown in side view in FIG. 1. Bullet 10 has a truncated hemi-spherical nose 11 having a hollow point 13. Hollow point 13 is conventional and merely causes the bullet to expand upon impact. Bullet 10 is, of course, fabricated from lead and preferably from lead wire formed under pressure in a die. The knurling which is discussed below is formed by a knurling machine.

Figure 4:
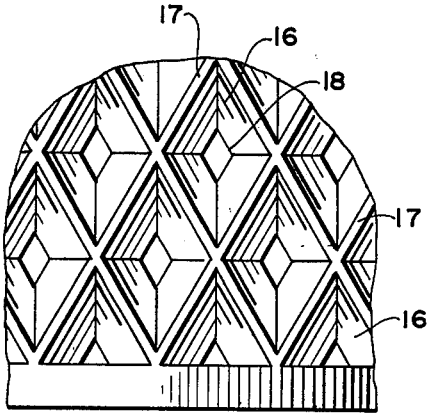
FIG. 4 is an enlarged portion of the outer surface of the bullet near the bottom thereof.

A first gas seal 14 is located at the upper end of the cylindrical portion of bullet 10 and comprises a smooth cylindrical portion which fits closely within the barrel of the gun. Below gas seal 14 is a knurled area 15 which is shown in enlarged view in FIG. 4. The knurled area is actually made up of a plurality of diamond-shaped depressions 16 which are surrounded by walls 17 which extend away from the bullet out to the surface of the cylindrical body of the bullet. The bottom of each depression is flat and is diamond shaped, indicated by reference character 18. Each of the depressions 16 is filled with a solid lubricant which may be a conventional bullet lubricant made up of beef or lamb tallow and beeswax. The lubricant may also contain other ingredients such as molybdinum disulfide or other synthetic lubricants to further improve lubricity. In use, the bullet is inserted in the muzzle of the muzzle loading firearm and driven to below the surface of the muzzle by hitting it with a wooden mallet referred to as a "starter". The bullet is then rammed to the bottom of the barrel by a ram rod, and the bullet of the present invention tends to lubricate the barrel during this ramming operation which has the tendency to reduce powder and lead fouling. This lubrication also improves the accuracy of the bullet in shooting.

A first grease groove 20 holds a quantity of the solid lubricant and in combination with the second gas seal 21 seems to substantially improve the accuracy of the bullet. Bullets fabricated merely with a knurled portion in place of the two grease grooves 20 and 22 and gas seal 21 was not nearly as accurate as the bullet of FIG. 1. A second knurled area 23 is identical in appearance with the first knurled portion and also contains a solid lubricant in each diamond-shaped depression. A rim 24 is located at the bottom of the bullet and a hollow depression 25 is formed in the bottom surface of the bullet to reduce weight. It is possible that the hollow depression also serves to expand the rim 24 of the bullet against the barrel aiding in the prevention of gases escaping around the bullet thus sealing the propellant gases and increasing spin and velocity. The bullet of the present invention may be made without depression 25 and early tests indicate improved accuracy when the depression is eliminated and the bottom of the bullet is flat.

Figure 2:
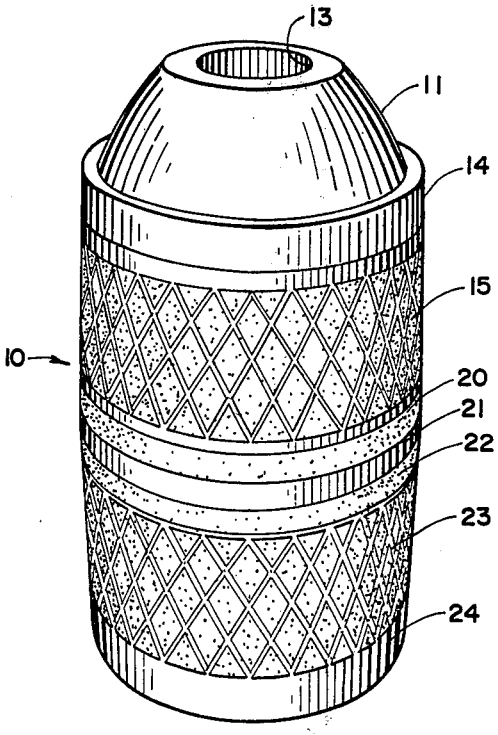
FIG. 2 is a perspective view of the bullet of FIG. 1.

The bullet 10 is shown in perspective view in FIG. 2 where the hollow point 13 is more clearly shown. FIG. 2 also clearly indicates that the lubricant extends between the rifle barrel and the walls 17 of the depressions 16. It is believed that this substantial area of contact is partly responsible for the surprising accuracy noted with the use of this bullet.

Figure 3:
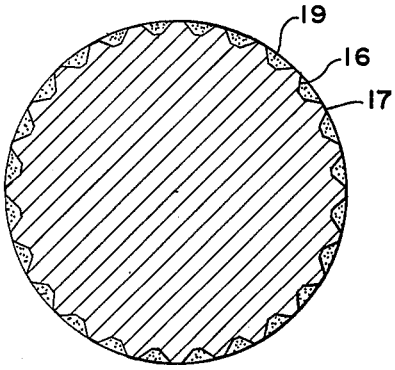
FIG. 3 is a cross-sectional view taken along line 3—3 of FIG. 1.

The bullet is shown in cross sectional view in FIG. 3 and the lubricant 19 is shown in the depressions 16. Although the depressions have been shown as diamond-shaped depressions, other shapes of depressions such as other polygons or circular or eliptical depressions may also be satisfactory. It is important, however, that the walls of the depressions extend about to the outer edge of the cylindrical body of the bullet to improve the contact between the bullet and the rifling of the bore of the firearm. The knurled portions of the bullet should comprise about one-half of the cylindrical portion of the body of the bullet although the amount of the knurled portions may vary from this and may be as little as one-quarter and as much as seven-eights of this length. While the bullet of the present invention would be operative with only one grease groove, the two grease grooves shown in the drawings are preferred.

The bullet of the present invention, although designed for use in muzzle loading firearms, has been shown to be very sueful in other firearms such as pistols and revolvers. It is further believed that the present invention would be useful for rifle bullets and shotgun slugs.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A bullet for firearms, said bullet comprising:

a generally cylindrical-shaped body terminating at its upper end with a generally hemi-spherical point having a truncated upper end;

a first gas seal comprising a cylindrical portion adjacent the point and extending to the outer surface of the body;

a first knurled portion having a plurality of open depressions having walls which extend to about the surface of the cylindrical body;

a second gas seal positioned below the first knurled portion and comprising a cylindrical portion extending to the outer surface of the body, said gas seal having at least one grease groove adjacent thereto, said grease groove being an annular groove extending below the surface of the body;

a second knurled portion positioned below the second gas seal having a plurality of open depressions having walls which extend to about the surface of the cylindrical body; and a solid lubricant located in the grease groove and in the depressions of the knurled portions.

2. The bullet of claim 1 wherein the knurled portions have diamond-shaped depressions.

3. The bullet of claim 1 wherein the knurled portions comprise about one-half of the surface of the cylindrical portion of the body.

4. The bullet of claim 1 wherein said lubricant contains animal tallow and beeswax.

5. The bullet of claim 1 wherein there are two grease grooves.

6. The bullet of claim 1 further including a hollow point.

7. The bullet of claim 1 further including a depression in the bottom of the bullet.

* * * * *